US005922254A

United States Patent [19]

Ebert et al.

[11] Patent Number: 5,922,254

[45] Date of Patent: Jul. 13, 1999

[54] METHOD AND APPARATUS FOR PRODUCING A MAT OF PRESET WIDTH AND THICKNESS FOR WOOD MATERIAL BOARDS OR SIMILAR BOARDS

[75] Inventors: Franz-Josef Ebert, Mühltal; Uwe Kunstmann, Rossdorf; Walter Henschel, Lengfeld; Hans-Werner Jost, Alsbach, all of Germany

[73] Assignee: Schenck Panel Production System, GmbH, Darmstadt, Germany

[21] Appl. No.: 08/831,278

[22] Filed: Apr. 1, 1997

[51] Int. Cl.[6] ..... B27N 3/04

[52] U.S. Cl. ..... 264/40.1; 264/109; 425/83.1

[58] Field of Search ..... 264/40.1, 109, 264/113, 121, 40.4, 40.7; 425/81.1, 83.1

[56] References Cited

U.S. PATENT DOCUMENTS

| | | | |
|---|---|---|---|
| 3,299,478 | 1/1967 | Gaitten | 425/81.1 |
| 4,063,858 | 12/1977 | Axer et al. | 425/81.1 |
| 4,068,991 | 1/1978 | Ufermann et al. | 425/81.1 |
| 4,359,151 | 11/1982 | Fyie et al. | 425/81.1 |
| 4,557,882 | 12/1985 | Arnold | 264/40 |
| 4,865,798 | 9/1989 | Henschel et al. | 425/83.1 |
| 4,931,243 | 6/1990 | Henschel et al. | 264/109 |
| 5,171,498 | 12/1992 | Powell | 425/81.1 |
| 5,342,566 | 8/1994 | Schäfer et al. | 264/102 |

FOREIGN PATENT DOCUMENTS

| | | | |
|---|---|---|---|
| 0109456 | 5/1984 | European Pat. Off. . | |
| 0292581 | 11/1988 | European Pat. Off. . | |
| 0626241 | 11/1994 | European Pat. Off. . | |
| 2308424 | 11/1976 | France | B05C 19/00 |
| 1205274 | 11/1965 | Germany . | |
| 2552662 | 6/1977 | Germany . | |

*Primary Examiner*—Mary Lynn Theisen
*Attorney, Agent, or Firm*—Fulbright & Jaworski, LLP

[57] ABSTRACT

A method and apparatus for preparing a mat of predetermined thickness from spreadable material for ligneous-material wall boards is disclosed.

14 Claims, 4 Drawing Sheets

Figure 1:
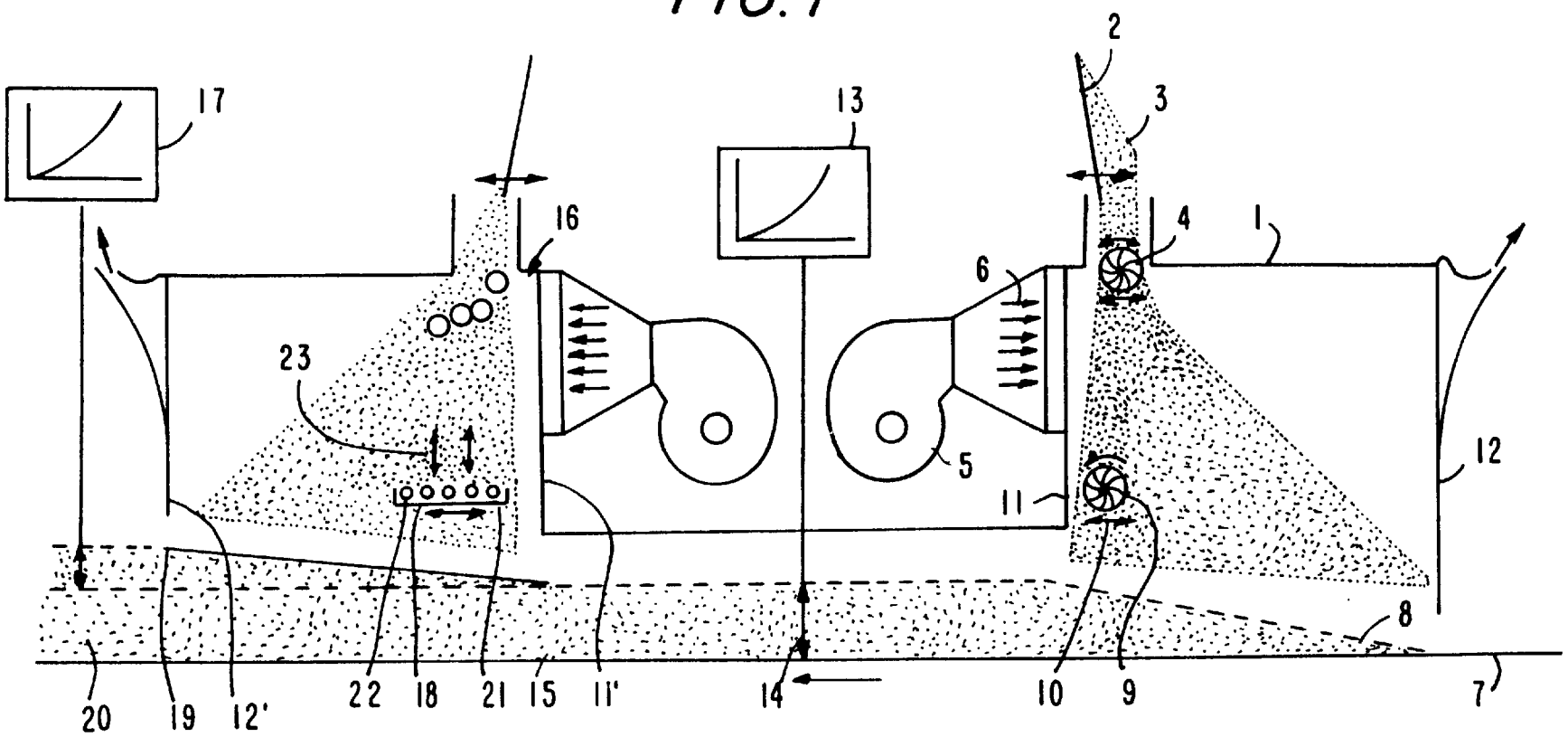

METHOD AND APPARATUS FOR PRODUCING A MAT OF PRESET WIDTH AND THICKNESS FOR WOOD MATERIAL BOARDS OR SIMILAR BOARDS

The invention relates to a method for producing a mat of preset width and thickness from a spreadable material for boards of ligneous material or similar boards, wherein the spreadable material is taken in a width corresponding to the preset width from a hopper and placed on a support beneath it which is continuously driven by a conveyor apparatus at right angles to the preset width, and wherein the spreadable material is subjected between the hopper and the support to at least one mechanical fluffing action, and below that to an air fluffing, extending across the entire spreading width, and it relates to an apparatus for the practice of the method.

The published European patent application 0626241 A1 discloses a method and an apparatus for the practice of the method as described above. The method therein disclosed had the object of depositing on a support a uniform, finely controlled material characterized by great uniformity. This is accomplished by forming across the entire width uniform amounts of material of equal density and then spreading it onto a support through a slot formed between two transport means. An improvement consists in additionally providing beneath this spreading apparatus a blower which produces an air flow and thus a separation of the particles being deposited.

In a method of this kind, and in an apparatus for practicing this method, it is not impossible that, due to the rotation of the individual rolls, segregation of materials within the spread may occur, and it will necessarily occur with particles of a particular grade in a particular charge. That is to say, the material used in the spread, even when it comes from a particular grading screen, will contain smaller and larger particles, and the smallest size will be smaller than the particle size that can barely pass through the screen. If a grade of this kind is used in a spread, segregations are bound to occur due to the roller feed, on account of the way the larger and smaller particles behave as they pass through a set of rolls. The segregation is not reduced, either, when components of vibration are additionally produced by the rolls. Nor can such segregation be countered by subsequent separation by a flow of air. The consequence is therefore the production of a mat for the manufacture of boards of ligneous material or the like, in which segregations or segregating zones are unavoidable.

The German utility model 29507686 discloses an apparatus for grading spreadable material, in which, instead of the rolls aligned transversely across the direction of movement, a screening section is used in which the individual screen itself is formed of rods arranged side by side while the axis of the individual rods runs in the direction of movement of the conveyor belt beneath them, and, through an appropriate configuration of the sockets of the rod ends, an enlargement of the gaps between the rods is produced in the vertical direction while the rods remain evenly spaced horizontally. This is accomplished by disposing, between every two rods disposed parallel to one another horizontally, one rod which is given an inclination from the horizontal in the direction of movement, for example by providing a sawtooth. This brings it about that, with increasing screen length, larger particles will be able increasingly to pass through this screen to be deposited on a conveyor belt disposed beneath it, running for example at a constant velocity. Here, again, in spite of the application of vibration to the individual screen plus an air current, any segregation that has occurred can no longer be remedied.

The present invention is addressed to the problem of remedying the defects which necessarily occur due to segregations of material which take place during a succession of fluffings of the material that is to be spread, between the hopper containing the material and its deposit in a mat, and at the same time permitting a specific distribution of material over a vertical cross section of a mat that is to be pressed.

This problem is solved according to the invention by the fact that, depending on the desired material distribution, especially a distribution of sizes through the thickness of the mat, subsequent to the at least single mechanical fluffing of the material following the air fluffing of the material before it is deposited on the substrate, the material is subjected to an additional controlled mechanical fluffing. Thus, the defects resulting from previous segregation are eliminated as a result of a controlled intervention, so that a mat is produced which can be pressed to form boards of ligneous material or the like. If such boards are then further processed by duplexing, painting or veneering the defects which formerly were to be looked for in the raw board no longer occur.

According to the present invention, protection is sought for the fact that, as a result of the invention, dependent upon regulation all the way to the application of a negative influence, even rejected mats can be put to use even in the event of severe separation.

If the additional mechanical fluffing is regulated in accordance with a measurement of the material distribution through the thickness of the mat, defects which have occurred in a preceding layer can still be compensated.

In a still further configuration of the method, influence is exercised on the basis that a defect, detected by a measurement through the thickness of the mat, is already remedied according to the invention, by the fact that upon measurement of the material distribution through a portion of the mat thickness from the additional mechanical fluffing, a section related only to this area is corrected. This then results in a portion of the mat thickness that is free of defects.

In still another embodiment of the method according to the invention that, in the case of the production of a mat required for compression to a ligneous material board or the like, in addition to a measurement of the material distribution through the entire mat thickness, the material distributions in the individual thickness ranges are measured, and that in accord with these results the corresponding portions can be corrected in the additional mechanical fluffing. This embodiment of the invention can be used especially when, as a result of an overhaul, a complete mat for a board is to be produced with one spreading station. In other words: if in one spreading station for a board to be produced, both the bottom layer, the middle layer and the top layer are to be produced, defects will necessarily occur in the bottom layer and/or in the middle layer and/or in the top layer, and they become very noticeable in the further processing of a board produced in this manner. So, in the manufacture of boards the wastage caused by rejected boards is not negligible. Here the invention comes in, if in the manufacture of the mat, devices are provided both for analyzing the full thickness of the mat and also for analyzing the individual layers. The defect can then be corrected on that basis.

Setting out from an apparatus for the practice of the method with a support of appropriate width for holding a mat of given width and thickness which moves continuously under a spreading station of corresponding width and length, wherein the spreading station is covered over its width with spreadable material from a hopper for the production of ligneous material boards or the like, wherein the spreadable material, carried by at least one preliminary fluffing roll running across the direction of movement of the support, is additionally treated by an air stream produced by a blower disposed beneath it as the spreading process continues. The essence of the present invention is seen in the fact that a blower, whose aspirating or compressing power is controllable, is disposed upstream or downstream in a wall defining the spreading station, and that a controllable system defining the bottom limit of the air stream and permitting an additional mechanical fluffing of the spreadable material is provided in the spreading station that is closed off by the continuously moving support.

By controlling the blower according to the invention, for one thing a still more finely measured continuous gradation in the separation of the spreadable material that has been pre-fluffed mechanically is achieved by controlled aspiration, so that even large-area flakes, such as those used for example in OSB (oriented strand board), are fed with still better separation to a controlled roll apparatus disposed underneath, according to the invention, by which the long, thin flakes can be laid down on the mat with a longitudinal orientation, i.e., in the direction of conveyor movement, as the bottom-most or top-most layer.

By varying the speed of the blower and also by varying the direction of the air stream, MDF (medium densified fibers) and normal three-layer boards can be manufactured in the same manner in the subordinate controlled apparatus according to the invention, in which, in some cases, extra-fine material is to be deposited additionally at the surface in both of the cover layers.

As an embodiment of the apparatus of the invention, it is proposed that, when the air stream is drawn through the spreadable material, a controlled-aperture shutter will be provided in the spreading station wall opposite the blower. By controlling the passage of air with the shutter—in other words, by varying the air passage openings in the shutter—an alignment of the air streams is achieved before they enter into the suction blower, so that in no case does turbulence occur in the spreading station on account of the air stream.

In still another embodiment of the apparatus of the invention, at least one roll defining the bottom of the air-stream area is provided, which is variable in speed and/or sense of rotation and extends transversely of the direction of movement of the support, and that the roll can be moved between the upstream and downstream walls of the spreading station. This embodiment of the invention makes it for the first time possible in a separating operation to prevent the formation anywhere in the spreading range of defects due to separation failures or unwanted segregations before the material is made into a mat.

Another embodiment of the invention consists, according to the present invention, in providing within a roll frame at least two rolls of variable distance apart, and variable speed and/or sense of rotation, which extend transversely of the direction of movement, and making the rolls displaceable between the downstream and upstream end walls of the spreading station. The use of such rolls according to the invention is especially advantageous when large amounts of relatively fine bulk material are involved, i.e., if the throughput is great, defects caused by segregations need to be corrected separately in the mat before the material is laid down. One embodiment of this further development of the invention is characterized by the fact that, with a plurality of rolls arranged in a roll frame, every third roll between two rolls can be raised and lowered. By the raising and lowering of the third roll disposed between two rolls, the material to be deposited is additionally controlled in a mat for greater or less separation.

In still another embodiment of the apparatus according to the invention, at least one additional roll frame having a plurality of rolls is disposed substantially underneath the roll frame. By this arrangement according to the invention, of at least two roll frames one over the other, it can be brought about that these two roll frames, which according to the invention can move independently of one another, are able each to cover the entire length of the spreading station to remedy a faulty spread, or else in cooperation with one another permit a deliberate build-up of the mat in excess of the thickness of the mat, with a high throughput.

In still another embodiment of the invention, protection is sought for the feature that the controllable apparatus defining the bottom of the air stream is inclinable from the horizontal. By this inclination according to the invention, a separation or a reduction of the separation already completed can additionally be achieved.

In still another embodiment of the subject matter of the invention, protection is sought for the feature whereby, in a measuring device associated with the spreading station, the material distribution through the thickness of the mat is determined, and the additionally controllable mechanical fluffer defining the bottom of the air stream area is regulated in accordance with any difference between the set value and the actual value. By the use according to the invention of a mat thickness measuring device in conjunction with a device measuring the distribution of the material through the thickness of the mat, an apparatus that is virtually entirely automatic is claimed for the production of ligneous material boards or the like, independently of the spreadable material that is used for building up a mat for pressing.

In still another embodiment of the subject matter of the invention, protection is sought for the feature that, at the end of the preliminary fluffing, or at at least one end of the controllable apparatus, a collecting means extending transversely across the direction of movement of the support is provided. By the arrangement of such systems it is brought about by the invention that no pieces negatively affecting the build-up of the mat, such as glue lumps, will occur in the mat that is to be pressed.

The invention is further explained with the aid of the following description of embodiments in conjunction with the drawing.

In a schematic manner,

FIG. 1 shows two spreading stations in tandem for producing a mat according to the invention for boards of ligneous material.

Figure 2:
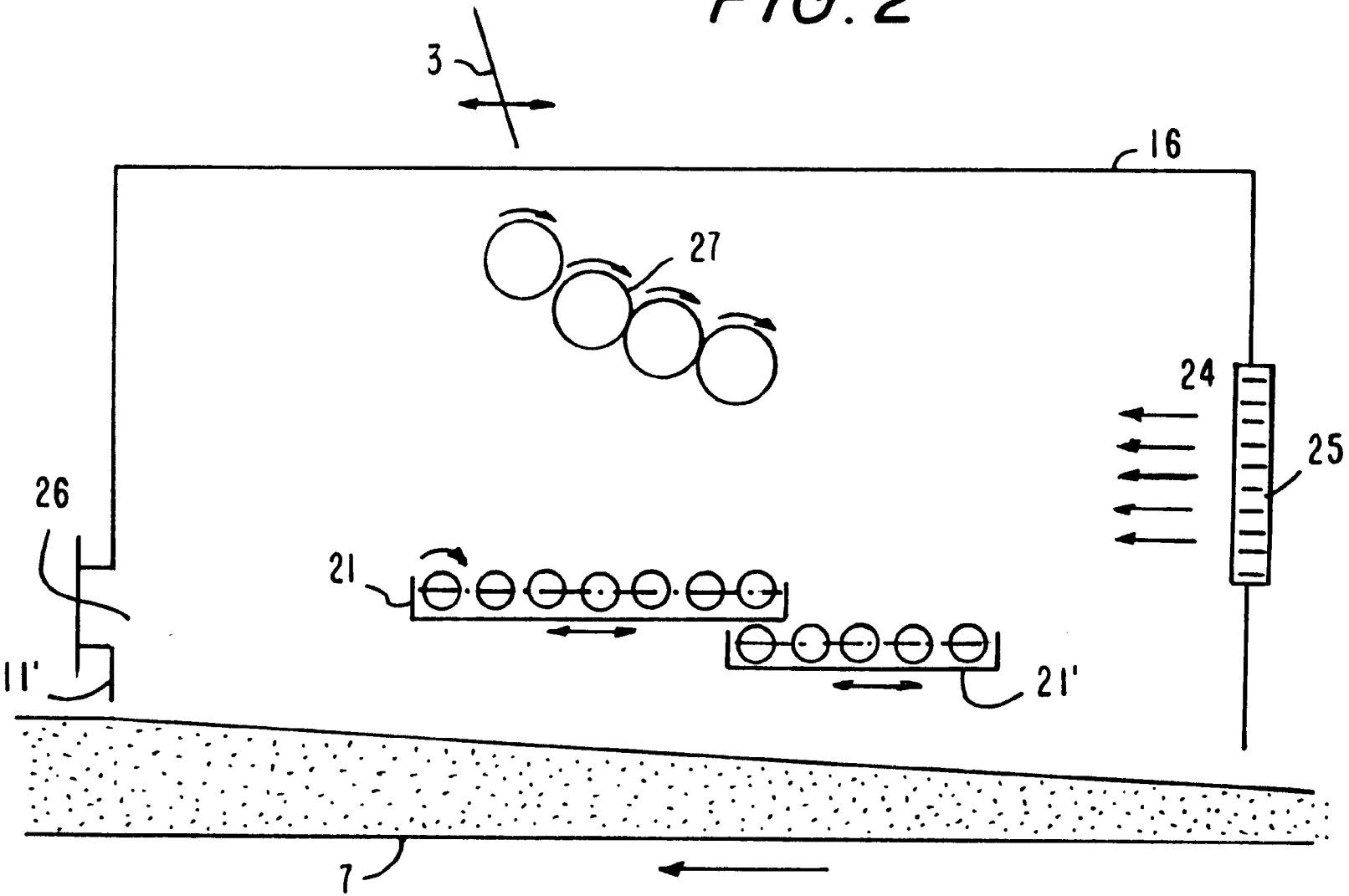

FIG. 2 another spreading station in which the mat according to the invention is produced by an aspirated air stream.

Figure 3:
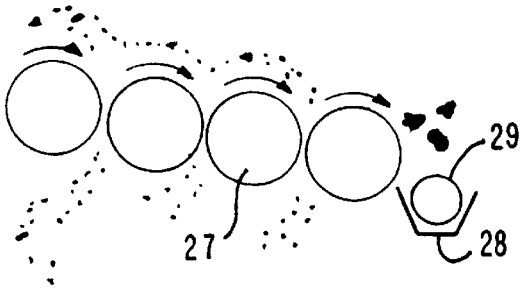

FIG. 3 a preliminary fluffing roll arrangement with a capture system, and

Figure 4:
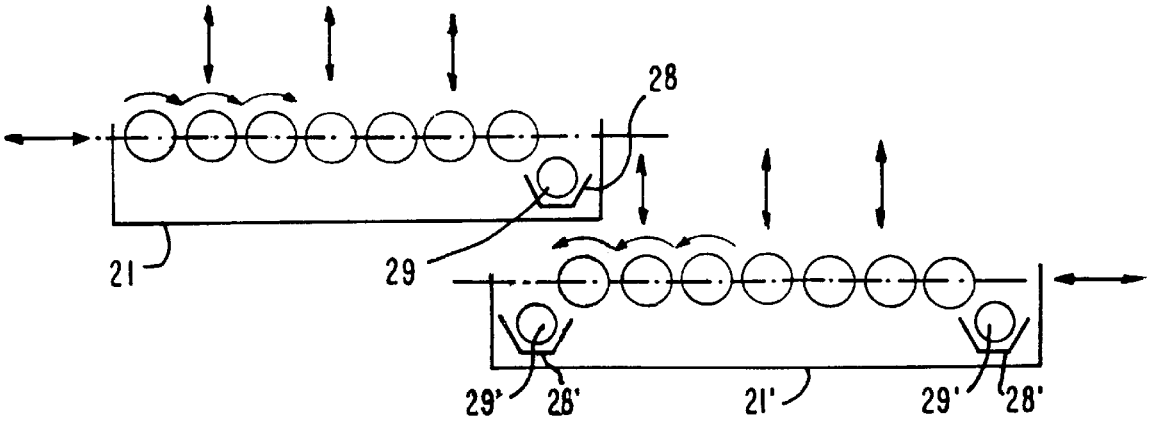

FIG. 4 two roll frames which can be moved back and forth independently of one another within a spreading station, with capture systems.

Figure 5:
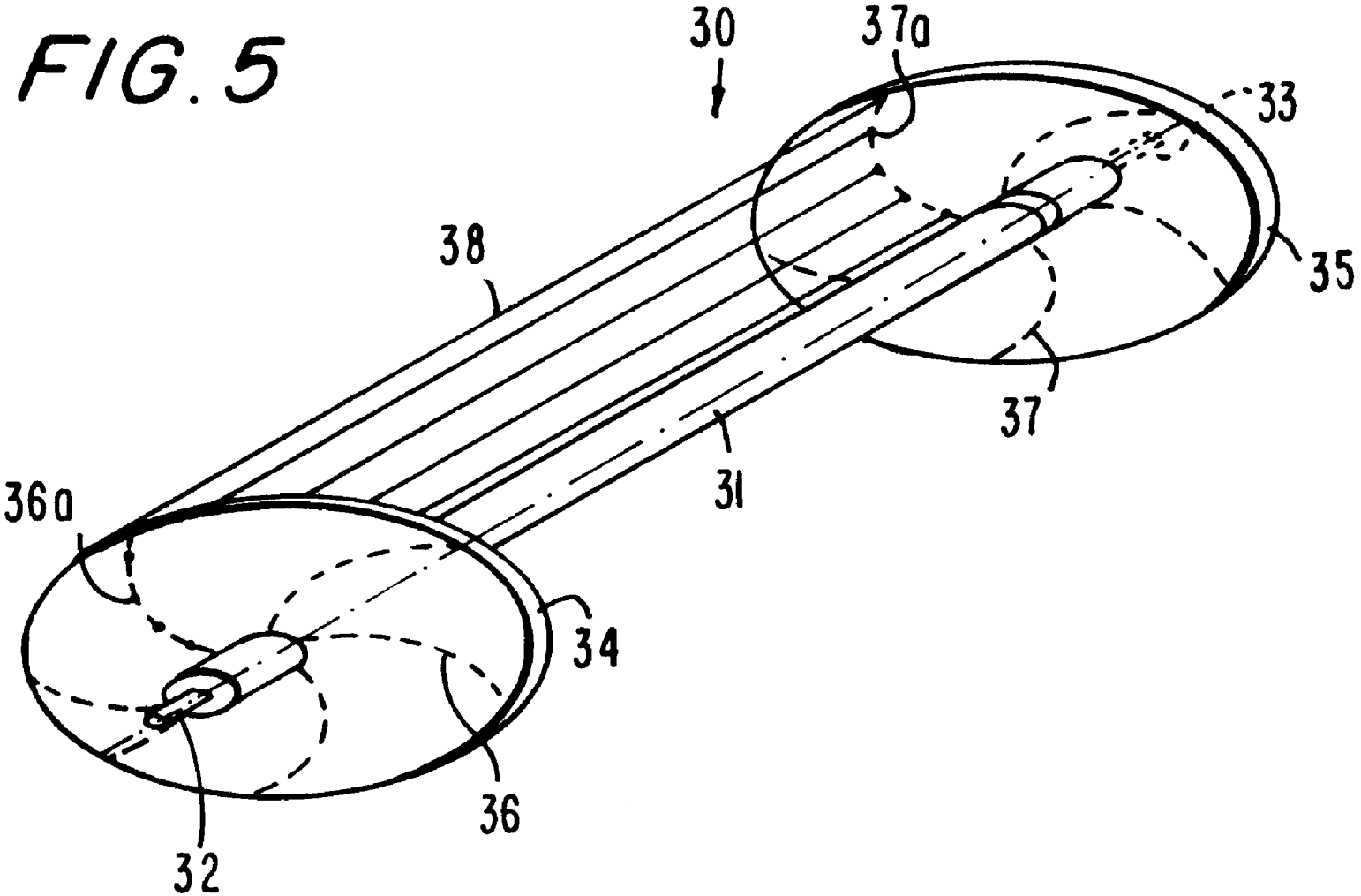

FIG. 5 an additional roll configured as a spoked roll.

Equal components in the individual figures are identified by the same reference numbers in the following description.

In FIG. 1, spreadable material 3 is delivered to a first spreading station 1 by an apparatus not represented, through a chute 2 which can move back and forth. The spreadable material 3 is brought over a roll 4 rotating counterclockwise into an air stream 6 produced by a first blower 5. To control a preliminary fluffing, the rotational speed of the clockwise rotating roll 4 is varied, and simultaneously this roll can additionally move back and forth horizontally as indicated by the arrow. Instead of the direction of rotation chosen in the embodiment in FIG. 1, an arrangement rotating clockwise is also possible, and also an arrangement in which the rolls rotate partially clockwise and partially counterclockwise. This generally applies also to the otherwise stated directions of rotation. This brings about a preliminary separation of the spreadable material which then is further separated by the air stream 6 that follows.

It is furthermore proposed by the invention to feed the mechanically separated and air-separated material 3 through a controlled mechanical fluffer to a uniform deposit in which the material particle thickness increases continuously in the mat 8. For this purpose an additional roll 9 is provided in the first spreading station 1, which in this embodiment likewise rotates counterclockwise, and which, as indicated by a double arrow 10, can be moved between a downstream wall 11 bearing the first blower 5 and an opposite upstream wall 12 of the first spreading station. Thus it becomes for the first time possible to achieve different states in the separated mat, so that the different board types can be produced by the spreading station of the invention, and also the latter can be adapted to the different types of material.

The additional roll 9 is regulated according to the different values obtained from a measuring apparatus 13 between the given set material distribution and the actual material distribution, both in its speed and in its position relative to the walls 11 and 12, until the measuring apparatus 13 reflects the desired material distribution through the thickness of the mat. The thickness 14 of a portion 15 of the mat leaving the first spreading station 1 is now fed to a second spreading station 16.

Following this second spreading station 16 an additional measuring apparatus 17 is provided which regulates an additional unit 18 according to the material distribution resulting at that point, so that a complete mat 20 having the desired material distribution issues from the exit of the second spreading station 16.

The additional unit 18 used in the second spreading station for controlled mechanical fluffing is a system 22 of rolls which is arranged in a roll frame 21, and in it the roll disposed between every two rolls can be raised or lowered as indicated by the vertical double arrow 23. Thus, as already explained in connection with the additional roll 9, the separation brought about by the mechanical preliminary fluffing and the air fluffing can be intensified or held steady or reduced.

The roll system 22 consisting of several rolls can be controlled, as already explained in regard to the additional roll 9, both in its speed and in its position with respect to the walls 12' and 11 ' situated upstream and downstream. It is also possible to make each roll of the roll system or roll sets controllable as to speed and direction of rotation.

As a result of the arrangement of two measuring apparatus 13 and 17, the spread through the entire thickness of the mat as well as through a portion thereof can be established. Thus it is possible to achieve a discontinuous distribution of material through the mat thickness, if such as required for a finished board of a ligneous material. This is conceivable, for example, in the case of OSB or MDF boards or even flake boards, which are to be veneered directly without crossbanding, or are to be merely painted or decorated with an overlay directly on the board.

In FIG. 2 there is shown an arrangement for the practice of the method of the invention, wherein a directed air stream 24, delivered by a blower not shown, passes through a stream of material 3 to be deposited on the support 7.

In this case the strength of the directed air stream 24 is determined by a shutter 25 which, by the variation of its openings, regulates the strength of the directed air stream 24. Through an outlet 26, which is disposed for example in the downstream wall 11 of the second spreading station 16, the air is aspirated by the blower which is not shown.

In the embodiment shown in FIG. 2, at first a plurality of preliminary fluffing rolls 27 are provided, whose speed is controllable, and which thus cause a desired preliminary fluffing of the material that is to be spread. The additional separation brought about by the air fluffing is performed by two roll frames 21 and 21' disposed below the air separator, these roll stands also being controllable either all together or also independently of one another, between the upstream and downstream walls of the second spreading station, so that the result is a particular intensification or abatement of the separation of the material being deposited on the mat.

In FIG. 3, the plurality of preliminary fluffing rolls 27 arranged at an angle to the horizontal border a collector 28 in which there is provided a screw conveyor 29 for carrying away materials not involved in the preliminary fluffing of incoming material. The sloping of the plurality of preliminary fluffing rolls toward the collector thus enhances the removal of material that is not to be spread.

Similarly, in FIG. 4 collectors 28 and 28' are provided in the roll frames 21 and 21', and they contain screw conveyors 29 and 29', respectively.

As it can be seen furthermore in FIG. 4, the roll frame 21' has collectors 28' and 29' at each end. This brings it about that, if the upper roll frame 29 is inclined and the roll frame extends over half the length of the spreading station, despite the horizontal alignment of the lower roll frame, assurance is given that all of the material that is not deposited in the mat, will definitely be carried away.

FIG. 5 shows another roll 9 configured as a spoked wheel 30. A shaft 31 bears at both ends journals 32, 33, which cooperate with bearings not shown. One journal, 32 for example, is furthermore connected through a drive, also not shown, to a motor, likewise not shown. The journals not shown, including the motor, can travel on rails, likewise not shown, so that the spoked wheel 30 can be moved back and forth between the two walls of the spreading station.

On the shaft 31 two end disks 34 and 35 are disposed, on which rows of bores are disposed in semicircular curves radiating from the center of these disks. In this embodiment, the end disks 34 and 35 have each five curving rows of bores 36 and 37, respectively.

Rods 38 connect the two end disks together and are arranged in the area of the lateral boundary of the substrate. Each rod 38 extends from a bore 36*a* in the end disk 34 to a bore 37*a* in end disk 35. The rods can be attached to the end disks 34 and 35 by means of screws, rivets or welding.

The spoked roll can then be rotated by the motor, not shown, and through a transmission between the motor and shaft 31, clockwise and counterclockwise, and can simultaneously also travel on bearings running on rails over the entire length of the spreading station.

We claim:

1. Method for preparing a mat of predetermined width and thickness from spreadable material for ligneous-material boards, said method comprising taking the spreadable material from a hopper on a width corresponding to the predetermined width, laying said spreadable material upon a support driven continuously at right angles to the predetermined width by a conveyor means, and subjecting the spreadable material between the hopper and the support, to at least one mechanical fluffing, and beneath it to a pneumatic fluffing, these operations extending over the entire spread width, so that, depending on the desired material distribution, especially a distribution of sizes through the thickness of the mat, and subsequent to the at least one mechanical fluffing and the pneumatic fluffing following beneath it, the material is subjected prior to deposit on the support to a controllable additional mechanical fluffing wherein said controllable additional mechanical fluffing is performed at a spreading station, wherein the mechanical fluffing is provided by contacting the material with a roll frame of said spreading station, said roll frame comprising at least one roll, wherein said at least one roll is variable in its speed or its rotation, extends transversely to the direction of moment of said support, and defines a bottom airstream, wherein said at least one roll is displaceable between the downstream and upstream end walls of said spreading station.

2. Method according to claim 1, wherein the separation of the material brought about by the at least one mechanical and the pneumatic fluffing, leads, due to the controllable additional mechanical fluffing, from a positively affected deposition, through an unaffected deposition, to a negatively affected separated deposition of the material in the mat.

3. Method according to claim 1, wherein the further mechanical fluffing is controlled according to a measurement of the distribution of the material through the mat thickness.

4. Method according to claim 3, wherein, in the measurement of the material distribution through a range of the mat thickness from the additional mechanical fluffing, a section relating only to this area is corrected.

5. Method according to claim 1, wherein, in the case of production of a mat required for pressing to a ligneous material board, in addition to a measurement of the material distribution through the entire mat thickness, the material distributions in the individual ranges of the mat thickness are additionally measured and the corresponding portions can be corrected in accordance with these results in the additional mechanical fluffing operation.

6. An apparatus comprising a support of appropriate width to receive a mat of given width and thickness and moving continually beneath a spreading station of corresponding width and length, wherein the spreading station is charged across its width from a hopper capable of containing spreadable material for the production of ligneous wood boards, wherein the spreadable material being carried over at least one preliminary fluffing roll disposed across the direction of advance of the support, is further influenced by an air stream produced by a blower disposed thereunder during the continued spreading process, characterized in that a blower of controlled aspirating or blowing power is disposed upstream or downstream of the material in a wall defining the spreading station and that a controllable apparatus defining the bottom of the air stream area and permitting an additional mechanical fluffing of the material being spread is provided in the spreading station closed off by the continually moving support wherein in one roll frame at least one roll is provided which is variable in its speed or sense of rotation, extends transversely to the direction of moment of the support, and defines the bottom of the air stream, wherein said at least one roll is displaceable between the downstream and upstream end walls of said spreading station.

7. Apparatus according to claim 6, wherein, if the air stream is aspirated through the spreadable material, a shutter controllable in its passage of air is provided in the wall of the spreading station opposite the blower.

8. Apparatus according to claim 6, wherein in one roll frame at least two rolls are provided, which are variable in their distance apart and/or their rotatory speed, extend transversely of the direction of movement of the support, and define the bottom of the air stream area, and that the rolls are displaceable between the downstream and upstream end walls of the spreading station.

9. Apparatus according to claim 8, wherein in an arrangement of a plurality of rolls in a roll frame, the third roll disposed in each case between two rolls can be raised and lowered.

10. Apparatus according to claim 8, wherein at least one additional roll frame with additional rolls is disposed substantially beneath the roll frame.

11. Apparatus according to claim 1, wherein the means defining the bottom of the air stream is inclinable from the horizontal.

12. Apparatus according to claim 1, wherein, in a measuring apparatus disposed in the spreading station, the distribution of material through the mat thickness is determined, and the additional mechanical fluffer defining the bottom of the air stream area is regulated on the basis of a difference between the measured value and the preset value.

13. Apparatus according to claim 1, wherein, at the end of the preliminary fluffing and/or at least one end of the controllable system, a collecting system extending transversely of the direction of movement of the support is provided.

14. Apparatus according to claim 6, wherein a shaft containing an axis of rotation and supported in bearings on the left, right and above the support is provided within the spreading station, that the shaft is driven by a motor, that the shaft bears two end disks at a distance apart, that the end disks are disposed in the area of the lateral limit of the support, that the end disks have rows of bores which curve semicircularly, and radiate from their center, reaching to the margin of the disks, and the end disks are connected together by rods which extend between the corresponding bores of the radially running rows of bores in the end disks.

* * * * *